US006109284A

United States Patent [19]

Johnson et al.

[11] Patent Number: 6,109,284

[45] Date of Patent: Aug. 29, 2000

[54] MAGNETICALLY-LATCHABLE FLUID CONTROL VALVE SYSTEM

[75] Inventors: Bruce G. Johnson, Monument; Oded E. Sturman, Woodland Park; Kathy M. Misovec, Woodland Park; Steve E. Massey, Woodland Park, all of Colo.

[73] Assignee: Sturman Industries, Inc., Woodland Park, Colo.

[21] Appl. No.: 09/257,921

[22] Filed: Feb. 26, 1999

[51] Int. Cl.[7] ..... F15B 13/043

[52] U.S. Cl. ..... 137/1; 91/459; 91/461; 137/625.63; 137/625.64

[58] Field of Search ..... 91/459, 461; 137/625.63, 137/625.64, 1

[56] References Cited

U.S. PATENT DOCUMENTS

| | | | |
|---|---|---|---|
| 3,683,239 | 8/1972 | Sturman . | |
| 3,743,898 | 7/1973 | Sturman . | |
| 4,409,638 | 10/1983 | Sturman et al. . | |
| 4,857,842 | 8/1989 | Sturman et al. . | |
| 4,870,892 | 10/1989 | Thomsen et al. . | |
| 5,138,838 | 8/1992 | Crosser | 91/461 X |
| 5,568,759 | 10/1996 | Aardema | 91/459 X |
| 5,598,871 | 2/1997 | Sturman et al. . | |
| 5,640,987 | 6/1997 | Sturman . | |
| 5,664,477 | 9/1997 | Koehler | 91/459 X |
| 5,720,261 | 2/1998 | Sturman et al. . | |
| 5,813,226 | 9/1998 | Krone et al. | 91/361 X |
| 5,960,695 | 10/1999 | Aardema et al. | 91/459 X |

OTHER PUBLICATIONS

"Application of Unified Predictive Control to On/Off Control of Hydraulic System Driven by Fast–Switching Solenoid Valves", Jeronymo et al., JSME International Journal, Series C, vol. 39, No. 3, pp. 515–520, 1996.

"Programmable Electrohydraulic Valve", Book et al., SAE Paper Offer 99F–10, 1998.

SAE Paper No. 981029, "Adaptive Lift Control for a Camless Electrohydraulic Valvetrain", Anderson et al., Int'l Congress and Exposition, Detroit, MI, Feb. 23–26, 1998.

SAE Paper No. 1999–01–0825, "Digital Valve Technology Applied to the Control of an Hydraulic Valve Actuator", Misovec et al., Int'l Congress & Exposition, Detroit, MI, Mar. 1–4, 1999.

"Advanced Control System Design", by Bernard Friedland, published 1996, excerpt pp. i, ii, v–viii and 129–161.

"Applied Optimal Control—Optimization, Estimation and Control", by Bryson, Jr. et al., published 1975, excerpt pp. i, ii, vii–xi, 108–117.

"Breakthrough in Digital Valves", reprint, Machine Design, Feb. 21, 1994.

"Developments in Digital Valve Technology", by Rob Wilson, repr8int, Diesel Progress North American Edition, Apr. 1997.

"The Swing to Cleaner, Smarter, Hydraulics", by Stuart Brown, excerpt pp. 152(A)(F)(J)(K), Fortune, Jun. 9, 1997.

"Vickers Taking Closer Aim at Mobile Markets", by Mike Brezonick, reprint, Diesel Progress North American Edition, Aug. 1997.

*Primary Examiner*—Gerald A. Michalsky

*Attorney, Agent, or Firm*—Blakely, Sokoloff, Taylor & Zafman

[57] ABSTRACT

A hydraulic valve control system that includes a plurality of digitally actuated magnetically-latchable four-way valves that directly or indirectly control the position of a hydraulic actuator. The digitally actuated magnetically-latchable four-way valves are controlled by a controller that can control the valves in accordance with a servo routine. The servo routine may include the computation of a plurality of cost functions and the selection of an action that corresponds to the lowest cost.

16 Claims, 2 Drawing Sheets

MAGNETICALLY-LATCHABLE FLUID CONTROL VALVE SYSTEM

BACKGROUND OF THE INVENTION

1. Field of the Invention

The present invention relates to a fluid valve control system adapted to control the flow of fluid to a device such as a hydraulic actuator, spool valve, or servomotor.

2. Background Information

Hydraulic control valve systems can be used to control hydraulically driven actuators. For example, earthmoving, material handling, construction, agricultural, or industrial equipment, or the like, may contain one or more hydraulically driven piston type actuators which move a bucket, dozer blade, shovel, forklift, boom, plow, planter, harvester etc. The hydraulic control valve system may control the flow of fluid to and from the actuator to induce a corresponding movement of the actuator piston.

U.S. Pat. No. 4,870,892 issued to Thomsen et al. on Oct. 3, 1989 discloses a hydraulic control valve system that can control the flow of fluid to a device such as an actuator. The control valve system includes a spool valve or servomotor that contains an internal spool. The spool can move within a valve housing to control the flow of fluid to the actuator. One end of the spool is coupled to a first fluid chamber. The other end of the spool is coupled to a second fluid chamber. Providing a pressurized fluid to the first fluid chamber moves the spool in a first direction. Pressurizing the second fluid chamber moves the spool in an opposite second direction. The spool can be moved into a neutral position by a pair of springs when both fluid chambers are connected to a drain line.

The Thomsen et al. control valve system has a pair of supply or pilot control valves that can be actuated to couple the fluid chambers of the spool valve to a pressurized supply line. The actuator valve also has a pair of drain control valves that can be actuated to couple the fluid chambers to the drain line. The supply control valves are normally closed. The drain control valves are normally open.

The control valves are connected to an electronic controller that controls the operation of the spool by providing a series of electrical pulses to the control valves. By way of example, the controller can provide current to open the supply control valve and close the drain control valve of the first fluid chamber. In this state the first chamber is pressurized to move the spool.

The control valves disclosed in Thomsen et al. are analog valves that can only move to the open or closed positions in response to an electrical current from the controller. The valves will return to a neutral state, either open or closed, upon the termination of the current. The analog valves thus require a continuous supply of current to switch from the natural state. The continuous current supply consumes power and may introduce undesirable heat within the valves. The heat may reduce the life of the valves. It would be desirable to provide a hydraulic control valve system which does not consume as much power or produce as much heat as control valve systems of the prior art.

The controller may receive an input command from an input device such as a joystick. The controller translates the input command to a desired spool position. The control valve system may have a sensor that detects the position of the spool and provides a position signal to the controller. The controller may compute an error value which corresponds to the difference between the desired position and the actual position. The controller may then provide electrical power to the control valves to move the spool toward the desired position based on the error value.

The controller may continuously calculate an error value and then provide power to the control valves to adjust the spool position in accordance with a servo routine. Actuating the control valves each time there is an error may not be an efficient use of power particularly if the error is a relatively small value. The continuous actuation of the control valves must be balanced with the desired accuracy of the spool position. It would be desirable to provide a control system for a hydraulic control valve system that optimizes electrical power consumption while minimizing tracking error.

SUMMARY OF THE INVENTION

One embodiment of the present invention is an improved fluid control valve system adapted to control a fluid actuator, spool valve, or servomotor. The control valve system includes a plurality of magnetically-latchable valves that control the spool position of a spool valve. The magnetically-latchable valves are controlled by a controller that can control the magnetically-latchable valves in accordance with a servo routine. The servo routine may include the computation of a plurality of cost functions and the selection of an optimum action or inaction that corresponds to the lowest cost. Alternatively, the servo routine may compute an error value and switch the digitally actuated magnetically-latchable valves to an optimum valve state for a selected time duration that corresponds to a function of the error value.

Advantageously, this arrangement is able to provide lower electrical power consumption, lower pilot actuating fluid consumption, and internal diagnostic feedback.

DETAILED DESCRIPTION

Figure 1:
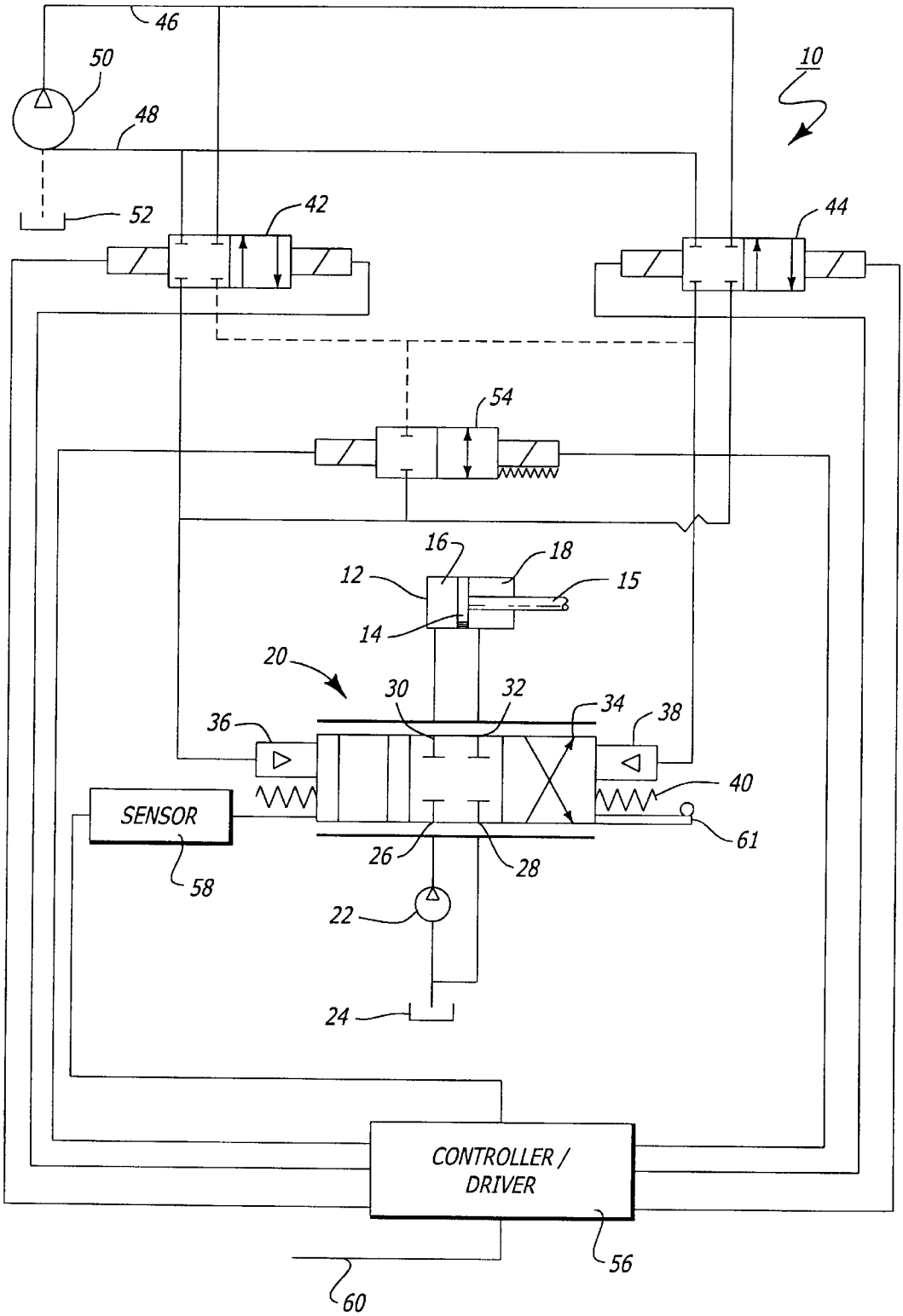
FIG. 1 is a schematic of an embodiment of a hydraulic control valve system of the present invention adapted for controlling movement or position of a hydraulic actuator.

Referring to the drawings more particularly by reference numbers, FIG. 1 shows an exemplary embodiment of a hydraulic fluid control valve system 10 of the present invention. The control valve system 10 is adapted to directly or indirectly control the flow of a hydraulic fluid to a device such as a hydraulic actuator or cylinder 12. The actuator 12 includes a piston 14 and rod 15 that are coupled to a first cylinder chamber 16 and a second cylinder chamber 18. Pressurizing only the first chamber 16 moves the piston 14 and rod 15 in a first direction. Pressurizing the only second chamber 18 moves the piston 14 and rod 15 in an opposite second direction. The control valve system 10 may control both the speed and direction of the piston 14 and rod 15. The rod 15 is directly or indirectly coupled to a movable working element or implement (not shown) such as a bucket, shovel, dozer blade, grading blade, snow plow blade, ram, chisel, crusher, compactor, forklift, boom, plow, planter, cultivator, fertilizer, sprayer, harvester, mower, or the like.

In the embodiment shown, the control valve system 10 further includes a spool valve or servomotor 20 that couples the actuator 12 to a hydraulic pump 22 and a drain tank 24.

The valve 20 has a supply port 26 connected to the pump 22 and a drain port 28 connected to the tank 24. The valve 20 also has a first cylinder port 30 connected to the first chamber 16 of the actuator 12 and a second cylinder port 32 connected to the second chamber 18. The spool valve 20 contains a spool 34 that can be driven between a first state and a second state. In its first state, the spool 34 couples the first chamber 16 to the drain tank 24, and the pump 22 to the second chamber 18 to induce movement of the piston 14 and rod 15 in the first (leftward) direction. In its second state, the spool 34 couples the first chamber 16 to the pump 22, and the second chamber 18 to the drain tank 24 so that the piston 14 and rod 15 move in the opposite second (rightward) direction. The first and second states of the spool 34 may each have multiple positions which each create a different fluid flowrate through the valve 20. The spool 34 may be also be moved to a neutral state which prevents fluid flow between the pump 22, the tank 24 and the chambers 16 and 18. In its neutral state, the spool 34 holds the position of the piston 14 and rod 15.

The spool valve 20 has a first fluid chamber 36 and a second fluid chamber 38 that are coupled to the spool 34. Pressurizing only the first chamber 36 switches the spool 34 to its first state. Pressurizing only the second chamber 38 switches the spool 34 to its second state. A pair of opposing springs 40 can move the spool 34 to a neutral position when the chamber pressures are substantially equal.

The control valve assembly 10 further includes a first digitally-actuated magnetically-latchable four-way valve 42 and a second digitally-actuated magnetically-latchable four-way valve 44 that are each coupled to a supply line 46 and a drain line 48. The supply line 46 is connected to the output of a hydraulic fluid pump 50. The drain line 48 is connected to an inlet of the pump and a drain tank 52.

The valves 42, 44 can be selectively actuated or switched between a first valve state, a second valve state, a third valve state, and a fourth valve state.

When in their first valve state, valve 44 is closed and valve 42 is opened thereby coupling fluid chamber 36 to the drain line 48 and also coupling fluid chamber 38 to the supply line 46. Consequently, the spool 34 is hydraulically moved (leftwardly per FIG. 1) towards its first state which, in turn, causes the piston 14 and rod 15 to be hydraulically moved (leftwardly per FIG. 1) towards their first or retracted state.

In their second valve state, valve 42 is closed and valve 44 is opened thereby coupling fluid chamber 36 to the supply line 46 and also coupling fluid chamber 38 to the drain line 48. Consequently, the spool 34 is hydraulically moved (rightwardly per FIG. 1) towards its second state which, in turn, causes the piston 14 and rod 15 to be hydraulically moved (rightwardly per FIG. 1) towards their second or extended state.

In their third valve state, the valves 42, 44 are both closed and therefore do not allow fluid flow between the fluid chambers 36, 38 and either line 46, 48. Consequently, the spool 34 is hydraulically held stationary at its latest position.

In their fourth valve state, valves 42, 44 are both opened thereby coupling both fluid chambers 36,38 to the supply line 46 and also coupling both fluid chambers 36,38 to the drain line 48. The fourth valve state may serve as a fail-safe mode of operation which allows the opposing springs 40 to center the spool 34 to its neutral position which, in turn, causes the piston and rod 15 to be hydraulically held in their latest position.

The actuator valve assembly 10 also has a manual override and fail-safe valve 54 that is connected to the first 36 and second 38 fluid chambers. The valve 54 may be a two-way valve that can be switched between an open position and a closed position. The valve 54 is preferably a spring-biased single coil two-way valve which exhibits a selected amount of residual magnetism insufficient to effect magnetic latching but sufficient to minimize holding electrical current. Alternatively, the valve 54 may be a spring-biased single coil two-way valve that does not exhibit residual magnetism. Alternatively, the valve 54 may be a two-way magnetically-latchable valve having two opposing coils.

In its open position, the valve 54 couples the first fluid chamber 36 with the second fluid chamber 38 to equalize the fluid pressure within the chambers 36,38. The equal pressures in fluid chambers 36,38 allows the opposing springs 40 to return the spool 34 to its neutral position or allows a lever 61 to be used by an operator to manually control the position of the spool 34. This advantageously allows manual control of the spool 34 i) instead of by the controller 56 or ii) in the event of an electronics failure. Alternatively, back-to-back spring-biased check valves arranged in parallel (not shown) may be substituted for the valve 54 to provide manual override.

With or without the valve 54, both four-way valves 42, 44 can be switched to their collective fourth valve state to couple both fluid chambers 36 and 38 to both the supply line 46 and the drain line 48. This equalizes the pressure in fluid chamber 36,38 allowing opposing springs 40 to return spool 34 to its neutral position or allows a lever 61 to be used by an operator to manually control the position of the spool 34. Although a relatively larger flowrate of pilot fluid may occur through the valves 42,44 when they are in their collective fourth valve state, such condition may be useful, for example, under cold starting conditions where such high recirculation of pilot fluid enables the pilot fluid to rapidly warm up to a desired operating temperature.

The four-way valves 42,44 are connected to an electronic controller 56. The controller 56 contains driver circuits that provide electrical pulses to actuate or switch the valves 42, 44 between their first, second, third, and fourth valve states. The controller 56 may further provide electrical signals to open the manual override and fail safe valve 54.

The digitally actuated magnetically-latchable four-way valves 42, 44 may be latched into or switched towards one of their selectable collective first, second, third, or fourth valve states with one or more digital pulse(s) of electrical current. The valves 42, 44 may be constructed from a material that retains a residual magnetism so that the selected valve state is maintained even when electrical power is not provided to the valves. The valves 42,44 can therefore be magnetically latched into any selected valve state with a digital pulse. The valves 42,44 does not require a continuous supply of electrical current to be maintained in any valve state. The digital latching control valve system of the present invention therefore requires less electrical power and generates less undesirable heat than known analog type control valves system. The valves 42, 44 may be the same or similar to the four-way valve disclosed in U.S. Pat. No. 5,640,987 issued to Sturman on Jun. 24, 1997, which is hereby incorporated by reference. The controller 56 may measure back emf voltages of each valve 42,44 in order to determine position or operability of the valves 42,44 and also to minimize the duration of electrical current applied to one or both of the valves 42,44 to achieve or change towards a desired valve state.

Referring to FIG. 1, it may be desirable to control the exact position of the spool 34 to regulate the fluid flow rate through the spool valve 20. The control valve system 10 may include a sensor 58 that is coupled to the spool 34 and connected to the controller 56. The sensor 58 may detect directly or indirectly the position of the spool 34 and provide a position signal to the controller 56. For example, the sensor 58 may be a Hall effect sensor, potentiometer, or linear variable differential transformer (LVDT).

The controller 56 receives an input signal on input line 60 that can be translated into a desired position of the spool 34. The controller 56 compares the actual spool position to the desired spool position and generates an error (e) if there is a difference between the desired and actual positions. The controller 56 then provides one or more additional digital pulses sufficient to switch the valves 42, 44 and move the spool 34 to the desired location. The controller may also generate an error alarm signal to an operator or another internal device if the error (e) exceeds a selected threshold.

It is desirable to provide a control system which minimizes a cost function that considers and chooses an optimum a tradeoff between tracking accuracy, which is the error between the desired and actual location of the spool 34, and control energy, which pertains to the frequency of switching the valves 42, 44. The digital nature of the latching valves 42, 44 allows for a control system that contains a finite set of control equations. At the beginning of a sampling period of time, the controller 56 must make a decision to move the spool in a first direction (leftwardly per FIG. 1), in an opposite second direction (rightwardly per FIG. 1), to maintain the position of the spool 34, or float the spool 34, allowing the opposing springs 40 to center it to its neutral position. The controller then implements this decision by providing digital pulses to valves 42, 44 to move them towards one of the aforementioned four valve states. The controller computes a predicted position for each of the valve states with the equations below. For example, the first valve state leads to the predicted position described by equation (1) below. The second valve state leads to a predicted position described by equation (2) below. The third and fourth valve states lead to predicted positions described by equations (3) and (4), respectively, below.

$$\hat{x}_{first}(t_i + T_s) = x(t_i) + v_{first}(t)(T_s - tdelay * switch) \quad (1)$$

$$\hat{x}_{second}(t_i + T_s) = x(t_i) - v_{second}(t)(T_s - tdelay * switch) \quad (2)$$

$$\hat{x}_{stay}(t_i + T_s) = x(t_i) \quad (3)$$

$$\hat{x}_{float}(t_i + T_s) = x(t_i) - v_{float}(t)(T_s - tdelay * switch) \quad (4)$$

where;

$t_i$=time at the beginning of the sampling period;

$T_s$=sampling period duration;

$x(t_i)$=spool position at the beginning of the sampling period;

$v_{first}$ (t)=estimated velocity of the spool going (left per FIG. 1) towards the first position, which may be a constant or may be a varying function of time that is learned by the controller 56;

$v_{second}$ (t)=estimated velocity of the spool going (right per FIG. 1) towards the second position, which may be a constant or may be a varying function of time that is learned by the controller 56;

$v_{float}$ (t)=estimated velocity of the spool in the float state, which may be a constant or may be a varying function of time that is learned by the controller 56;

tdelay=switching delay time;

switch=flag variable. It may have a value of one if the control action is changing from the last sampling period or zero otherwise.

The cost functions below may also computed by the controller 56. These are functions of the errors associated with the four possible valve states.

$$J_{first} = \int_0^t (e(\tau))^2 d\tau + (\hat{e}_{first}(t_i + T_s))^2 + K_{first}(v_{\max} T_s switch)^2 \quad (5)$$

$$J_{second} = \int_0^t (e(\tau))^2 d\tau + (\hat{e}_{second}(t_i + T_s))^2 + K_{second}(v_{\max} T_s switch)^2 \quad (6)$$

$$J_{stay} = \int_0^t (e(\tau))^2 d\tau + (\hat{e}_{stay}(t_i + T_s))^2 + K_{stay}(v_{\max} T_s switch)^2 \quad (7)$$

$$J_{float} = \int_0^t (e(\tau))^2 d\tau + (\hat{e}_{float}(t_i + T_s))^2 + K_{float}(v_{\max} T_s switch)^2 \quad (7)$$

These cost functions are functions of the errors associated with the four possible valve states. The errors are defined as the difference between the desired position and the predicted actual position from equations (1),(2), (3), and (4). The first terms of the cost functions correspond to the integrated effect of the errors at the beginning of a sample period. The second terms are a predicted value obtained by calculating projected new positions of the spool 34 using equations (1), (2), (3), (4) and then the corresponding error values using a projected value of the desired trajectory. The third terms are the cost associated with switching the valves 42, 44 and are weighted by constants $K_{first}$, $K_{second}$, $K_{stay}$, or $K_{float}$. The controller 56 computes the cost functions associated with each sample and then selects an action with the lowest associated cost. For example, if the cost function Jfirst has the lowest value, the controller 56 will provide pulses to switch the valves 42 and 44 and move the spool 34 in its first direction. The cost functions may contain additional terms such as error values that have been filtered in alternative ways.

Figure 2:
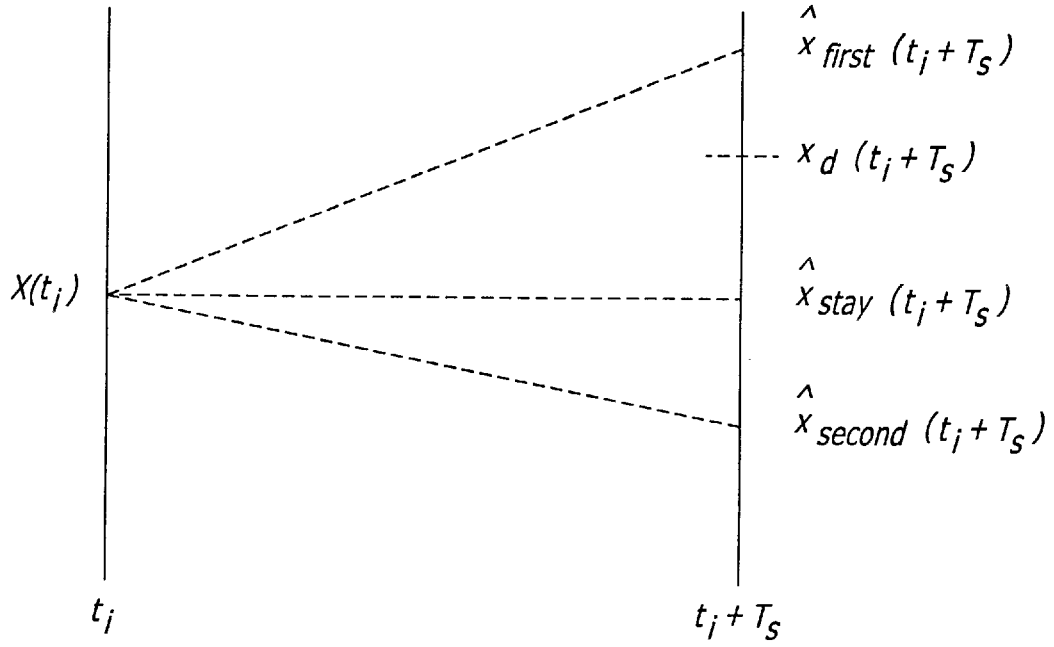
FIG. 2 is an exemplary graph to illustrate a cost function control method of the present invention.

For example, FIG. 2 shows how the controller 56 could choose between the move in the first or second directions, and stay options when there is no delay and no cost on switching. Using estimated velocities, the controller 56 predicts the error at the next sampling time for each of the three possible control actions, move first direction, move second direction or stay. In the case of no additional cost on switching, the best control action pictured above would be to open the valves 42, 44.

This method of control is called the cost function control method. An advantage of this method is that it provides a tradeoff between tracking error and how often the valves 42, 44 switch. Another advantage of the control method is the ability of this controller 56 to learn on line how the system is behaving and adjust the velocity estimates, $v_{first}$ and $v_{second}$ to achieve better tracking. The fact that the digitally actuated magnetically-latchable valves 42, 44 have a finite set of control actions and the predicted positions in equations (1), (2), (3), and (4) can be computed by the controller 56 allow the optimization problem to be solved.

The controller 56 provides an electrical pulse to switch one or both of the valves 42, 44 towards their open or closed positions to move the spool 34 in the first or second directions or stay in the same position.

Figure 3:
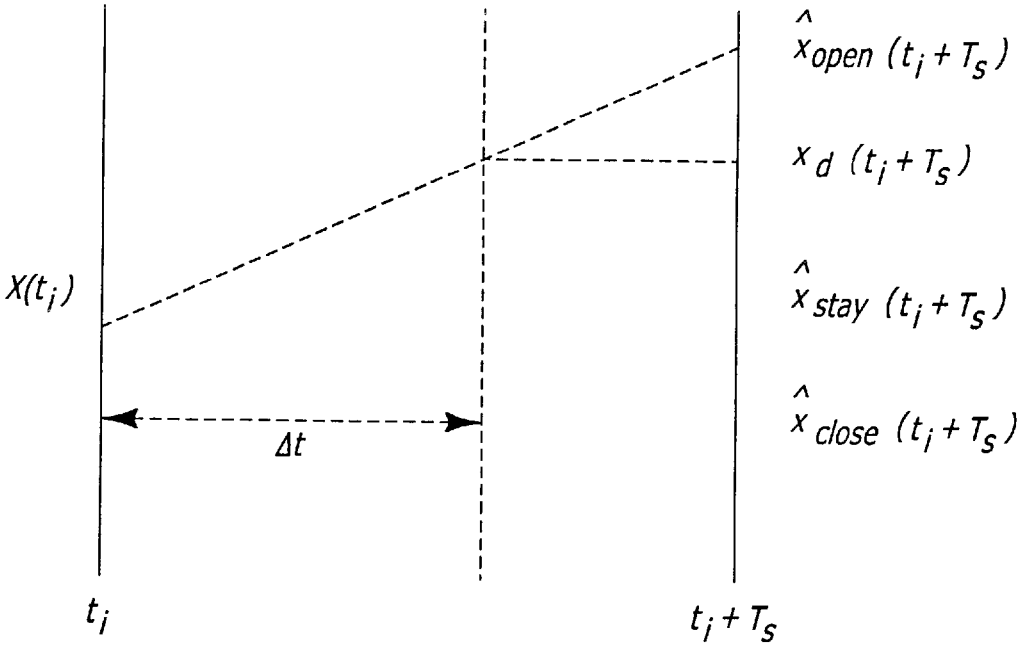
FIG. 3 is an exemplary graph to illustrate an inner sample modulation method of the present invention.

Another method of control which can be used by the control valve system 10 of the present invention is called the inner sample modulation method. This control incorporates the cost function method and additionally, the pulses of electrical current to switch the valves 42, 44 can be adjusted to be a fraction of the sampling period rather than the entire sampling period. For example, FIG. 3 shows the same example as in FIG. 2, but in this case, the controller 56 could choose to open for only a selected fraction At of the sampling time.

The time interval At pulses are applied to switch the valves 42, 44 so that the fluid is provided to fluid chambers 36 or 38 to move the spool 34 may be proportional to the tracking error (e) divided by the estimated velocity $v_{first}$ or $v_{second}$ of the spool 34. These estimated velocities may be a function of time that is learned by the controller 56 based on storing, filtering and processes error values as a function of time. Using estimated velocities, the controller predicts the error at the next sampling time for each of the three possible control actions, move first direction, move second direction or stay. In the case of no additional cost on switching, the best control action pictured above would be to open the valve.

Additionally, the controller 56 may be arranged to not provide an electrical pulse unless the time interval $\Delta t$ exceeds a selected threshold value.

One advantage of the inner sample modulation method is the ability to achieve fine motion control with low tracking errors while not having to switch as frequently. Another advantage of the inner sample modulation method is that robustness to uncertainty in the estimated velocities can be improved by adjusting the time interval $\Delta t$. The inner sample modulation method also features all of the advantages of the cost function method.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, although a spool valve 20 is shown and described, it is to be understood that the valves 42, 44 and 54 may be connected directly to the actuator 12 without an intermediate spool valve 20. Alternatively or additionally, a sensor may be provided to directly or indirectly detect the position of the piston 14 or rod 15 of the hydraulic actuator 12 and provide a position signal to the controller 56.

What is claimed is:

1. A fluid driven control valve system adapted to be coupled to a supply line and a drain line and further adapted to control movement of a fluid driven actuator, said fluid driven control valve system comprising:

the fluid driven actuator having a first fluid chamber and a second fluid chamber;

a first digitally actuated magnetically-latchable four-way valve, the first digitally actuated magnetically-latchable four-way valve actuatable to couple the first fluid chamber to the supply line and the second fluid chamber to the drain line;

a second digitally actuated magnetically-latchable four-way valve, the second digitally actuated magnetically-latchable four-way valve actuatable to couple the first fluid chamber to the drain line and the second fluid chamber to the supply line; and a controller coupled to the first and second digitally actuated magnetically-latchable four-way valves, the controller operable to selectively actuate at least one of said first and second digitally actuated magnetically-latchable four-way valves.

2. The fluid driven control valve system of claim 1, further comprising:

a main spool valve having a spool, a first fluid chamber, and a second fluid chamber, said main spool valve coupled between the fluid driven actuator and the first and second digitally actuated magnetically-latchable four-way valves.

3. The fluid driven control valve system of claim 1, wherein said first and second digitally actuated magnetically-latchable four-way valves are selectively switchable by said controller between i) a first valve state, the first valve state to couple said first fluid chamber to the drain line and the second fluid chamber to the supply line, and ii) a second valve state, the second valve state to couple said first fluid chamber to the supply line and the second fluid chamber to the drain line.

4. The fluid driven control valve system of claim 3, wherein said first and second digitally actuated magnetically-latchable four-way valves are switchable to a third valve state, the third valve state of the first and second digitally actuated magnetically-latchable four-way valves to isolate the first and second fluid chambers from both the supply line and the drain line.

5. The fluid driven control valve system of claim 4, wherein said first and second digitally actuated magnetically-latchable four-way valves are switchable to a fourth valve state, the fourth valve state of the first and second digitally actuated magnetically-latchable four-way valves to couple the first and second fluid chambers to the supply line and the drain line respectively.

6. The fluid driven control valve system of claim 4, wherein said first and second digitally actuated magnetically-latchable four-way valves are switchable to a fourth valve state, the fourth valve state of the first and second digitally actuated magnetically-latchable four-way valves to couple the first and second fluid chambers to the drain line and the supply line respectively.

7. The fluid driven control valve system of claim 1, further comprising a sensor operable to sense position of the fluid driven actuator and to provide an indicative position signal to said controller.

8. The fluid driven control valve system of claim 7, wherein said controller is operable to compute an error value and switch said first and second digitally actuated magnetically-latchable four-way valves to one of four valve states for a time duration, the time duration being a function of the error value.

9. The fluid driven control valve system of claim 8, wherein said controller is operable to compute a plurality of cost functions and switch said digitally actuated magnetically-latchable four-way valves to one of the four valve states in accordance with the cost function which has the lowest value.

10. The fluid driven control valve system of claim 9, wherein said controller is operable to compute a desired valve state and a duration of time for the desired valve state, the computation of the desired valve state being a function of the error value.

11. The fluid driven control valve system of claim 10, wherein the controller is further operable to switch the first and second digitally actuated magnetically-latchable four-way valves to the desired valve state for the desired duration of time.

12. The fluid driven control valve system of claim 7, wherein said controller is operable to compute a desired valve state and a duration of time for the desired valve state, the computation of the desired valve state being a function of the error value and the controller is further operable to switch said first and second digitally actuated magnetically-latchable four-way valves to the desired valve state for the desired duration of time.

13. The fluid driven control valve system of claim 7, wherein the four valve states for the first and second digitally actuated magnetically-latchable four-way valves are i) a first valve state, the first valve state to couple said first fluid chamber to the drain line and the second fluid chamber to the supply line;

ii) a second valve state, the second valve state to couple said first fluid chamber to the supply line and the second fluid chamber to the drain line;

iii) a third valve state, the third valve state to isolate the first and second fluid chambers from both the supply line and the drain line; and iv) a fourth valve state, the fourth valve state to couple the first and second fluid chambers to the supply line and the drain line respectively.

14. A control valve system adapted to be coupled to a supply line and a drain line, comprising:

a main valve having a spool, a first fluid chamber and a second fluid chamber, the spool being coupled to the first fluid chamber at one end and the second fluid chamber at another end;

a first digitally actuated magnetically-latchable four-way valve coupled to the supply and drain lines and the main valve, the first digitally actuated magnetically-latchable four-way valve being actuatable to couple said first fluid chamber to the drain line and the second fluid chamber to the supply line;

a second digitally actuated magnetically-latchable four-way valve coupled to the supply and drain lines and the main valve, the second digitally actuated magnetically-latchable four-way valve being actuatable to couple the first fluid chamber to the supply line and the second fluid chamber to the drain line; and a controller coupled to the first and second digitally actuated magnetically-latchable four-way valves, the controller to actuate said first and second digitally actuated magnetically-latchable four-way valves.

15. A method of operating a fluid driven control valve system adapted to control movement of a fluid driven actuator, said method comprising the steps of:

accepting a desired fluid driven actuator position;

sensing an actual fluid driven actuator position;

computing an error that is a function of the actual and desired fluid driven actuator positions;

calculating a plurality of cost functions which are a function of the error;

determining the lowest cost function; and, switching a pair of digitally actuated magnetically-latchable four-way valves to a collective valve state associated with the lowest cost function, wherein the four-way valves control movement of the fluid driven actuator.

16. The method of claim 15, wherein each cost function includes a first term associated with a present error, a second term associated with a predicted error, and a third term associated with switching said fluid driven control valve system.

* * * * *